US011107641B2

(12) United States Patent
Gauthier et al.

(10) Patent No.: US 11,107,641 B2
(45) Date of Patent: Aug. 31, 2021

(54) MINIATURE ELECTRIC SWITCH OF THE NORMALLY CLOSED TYPE COMPRISING AN OPEN CONTACT LOCKING POSITION

(71) Applicant: C&K COMPONENTS S.A.S., Dole (FR)

(72) Inventors: Philippe Gauthier, Liesle (FR); Fabrice Valcher, Dole (FR); Jocelyn Mayot, Sampans (FR)

(73) Assignee: C&K Components S.A.S.

( * ) Notice: Subject to any disclaimer, the term of this patent is extended or adjusted under 35 U.S.C. 154(b) by 0 days.

(21) Appl. No.: 17/069,945

(22) Filed: Oct. 14, 2020

(65) Prior Publication Data

US 2021/0125794 A1 Apr. 29, 2021

(30) Foreign Application Priority Data

Oct. 25, 2019 (FR) ..... 1911956

(51) Int. Cl.

| | |
|---|---|
| ***H01H 1/24*** | (2006.01) |
| ***H01H 9/02*** | (2006.01) |
| ***H01H 9/20*** | (2006.01) |
| ***H01H 21/22*** | (2006.01) |

(52) U.S. Cl.

CPC ..... *H01H 1/24* (2013.01); *H01H 9/02* (2013.01); *H01H 9/20* (2013.01); *H01H 21/22* (2013.01)

(58) Field of Classification Search

CPC .. H01H 1/24; H01H 9/02; H01H 9/20; H01H 21/22; H01H 1/14; H01H 1/26; H01H 21/18; H01H 2205/002; H01H 23/12; H01H 23/14; H01H 23/24

USPC ..... 200/238, 239, 244, 271, 272, 275, 293, 200/339, 553

See application file for complete search history.

(56) References Cited

U.S. PATENT DOCUMENTS

| | | | | |
|---|---|---|---|---|
| 2,725,438 | A | 11/1955 | Bentey | |
| 6,040,543 | A | 3/2000 | Mina et al. | |
| 6,762,379 | B1 * | 7/2004 | Su | H01H 1/242 200/276.1 |
| 9,218,926 | B1 | 12/2015 | Pierce | |
| 9,224,556 | B2 * | 12/2015 | Arihara | H01H 21/14 |
| 2012/0193197 | A1 * | 8/2012 | Lin | H01H 9/02 200/293 |

FOREIGN PATENT DOCUMENTS

| | | | |
|---|---|---|---|
| AT | 250484 | B | 11/1966 |

* cited by examiner

*Primary Examiner* — Edwin A. Leon
*Assistant Examiner* — Iman Malakooti
(74) *Attorney, Agent, or Firm* — Fox Rothschild LLP

(57) ABSTRACT

An electric switch of the normally closed type has a housing including a lower part that supports a fixed contact track, an internal contact blade that is resiliently deformable in order to assume a bottom rest position in order to establish an electric switching way, a first high non-stable position, in which the switching track is interrupted, and a second high stable position, in which the electric switching track is interrupted and in which the internal contact blade is locked such as by retractable locking structure, and an actuator to control the deformations of the internal contact blade.

15 Claims, 11 Drawing Sheets

MINIATURE ELECTRIC SWITCH OF THE NORMALLY CLOSED TYPE COMPRISING AN OPEN CONTACT LOCKING POSITION

RELATED APPLICATIONS AND CLAIM OF PRIORITY

This patent document claims priority under 35 U.S.C. § 119(1) to France Patent Application Number 1911956 filed Oct. 25, 2019.

TECHNICAL FIELD

The invention relates to an electric switch of the normally closed type comprising a resiliently deformable blade that causes the electric switch to change state in response to the application of an actuating force on the resiliently deformable blade and wherein, without the application of an actuating force, the electric switch is kept in a closed state.

BACKGROUND

In an electric switch of a normally closed type, without a force acting on the actuator, the electric switch is resiliently held under load in its closed state. Following the integration of an electric switch of this type in an electronic or electromechanical appliance, its conventional use involves interrupting the electric switching way by acting on its actuator before the first use or operational start-up of the appliance. The appliance then can be stored for a potentially very long period without consuming energy. During the first use causing at least one first change of state of the electric switch, the switch at least temporarily assumes its closed state, in which the electric switching way is established.

Such a design can be troublesome, particularly when the electric switch is assembled on an electronic board comprising an electric battery or cell. Indeed, before being integrated in the electronic appliance, the electric switch is not activated and it is in its closed state, which leads to consumption of the energy accumulated in the electric battery or cell of the appliance.

SUMMARY

This patent document proposes an electric switch comprising a means for locking in an open position, i.e. in a state in which the electric switching way is interrupted. The electric switch can be of a compact design and that allows actuating over-travel to be absorbed. In some embodiments, the switch that may be automatically unlocked when it is supported by a sub-assembly that is installed and assembled in an electronic appliance.

Therefore, in some embodiments, a switch of the normally closed type comprise a housing comprising an upper part made of insulating material and a complementary lower part that supports a fixed internal contact track. The switch also comprises an internal contact blade that is supported by the upper part and that is resiliently deformable in order to assume: (i) a bottom rest position, in which it is in downwards resilient abutment on the lower fixed contact track in order to establish an electric switching way; (ii) a first high non-stable position, in which the electric switching way is interrupted; and (iii) a second high stable position, in which the electric switching way is interrupted and in which the internal contact blade is locked by retractable locking means. The switch also includes an actuator to control the deformation of the internal contact blade. The actuator, from a rest position in which the internal contact blade is in its bottom rest position and towards which it is resiliently returned, is pivotably mounted, about a horizontal axis, between: (a) a first angular actuating position, in which the internal contact blade is in its first high non-stable position; and (b) a second angular actuating position, in which the internal contact blade is in its second high stable position.

In some embodiments, the rest position of the actuator may be an intermediate angular position between its first and second angular positions for activating the internal contact blade.

In some embodiments, the internal contact blade successively comprises: a rear section for fixing it to the upper part of the housing; an intermediate actuating section; and a front contact section. The front contact section, in the bottom rest position of the internal contact blade, is in downwards resilient abutment on the lower fixed contact track in order to establish the electric switching way. The actuator may comprise a control cam, the cam profile of which engages with the intermediate actuating section of the internal contact blade.

In some embodiments, the resiliently deformable internal contact blade engages with the control cam of the actuator to assist the resilient return of the actuator towards its rest position.

In some embodiments, the intermediate actuating section of the internal contact blade extends substantially horizontally above the control cam and above the pivot axis of the actuator.

In some embodiments, the pivot axis of the actuator is located inside the housing.

In some embodiments, the upper part of the housing comprises a locking notch, and the actuator comprises a locking lug that engages with the locking notch in order to lock the internal contact blade in its second high stable position.

As an alternative embodiment, the lower part of the housing comprises a locking notch, and the actuator comprises a locking lug that engages with the locking notch for locking the internal contact blade in its second high stable position.

If so, then optionally, the switch comprises an internal blade for stabilizing the actuator that comprises a stabilization section, the actuator comprises a control cam, the cam profile of which engages with the stabilization section of the internal stabilization blade.

Also, optionally the lower part of the housing comprises a horizontal lower plate for closing the housing, and the fixed internal contact track is a portion of the upper face of this lower plate.

Also, optionally, the lower plate of the lower part of the housing comprises a resiliently deformable branch that engages with a complementary portion opposite the actuator to assist the resilient return of the actuator from its first angular actuating position to its rest position.

As an alternative embodiment, the lower plate of the lower part of the housing comprises a resiliently deformable tab that comprises the locking notch.

If so, then optionally the actuator comprises an arm for causing the actuator to pivot in both directions, which arm vertically projects upwards through the upper part of the housing.

Also, optionally, the second high stable position of the internal contact blade corresponds to an initial delivery state of the electric switch.

This document also proposes an assembly comprising an electronic board and a switch according to the invention, characterized in that the electric switch is mounted on a face of the electronic board and is adjacent to an edge of the electronic board so that, if the assembly is placed in an electronic appliance, the internal contact blade of the electric switch is automatically unlocked as a result of its actuator coming into contact with a portion opposite the electronic appliance or belonging to assembly means.

BRIEF DESCRIPTION OF THE FIGURES

Further features and advantages of the invention will become apparent from reading the following detailed description, which is understood with reference to the accompanying drawings, in which.

DETAILED DESCRIPTION

For the description of the invention and in order to understand the claims, the vertical, longitudinal and transverse orientations will be adopted, by way of a non-limiting example and without limiting reference to terrestrial gravity, according to the V, L, T coordinate system indicated in the figures, in which the longitudinal L and the transverse T axes extend in a horizontal plane.

By convention, the longitudinal axis L is oriented from the back to the front.

In the following description, identical, similar or comparable elements will be denoted using the same reference signs.

As used in this document, the singular forms "a," "an," and "the" include plural references unless the context clearly dictates otherwise. Unless defined otherwise, all technical and scientific terms used in this document have the same meanings as commonly understood by one of ordinary skill in the art. As used in this document, the term "comprising" (or "comprises") means "including (or includes), but not limited to."

In this document, when terms such "first" and "second" are used to modify a noun, such use is simply intended to distinguish one item from another, and is not intended to require a sequential order unless specifically stated.

First Embodiment: Switch with Two Internal Contact Blades

Figure 1:
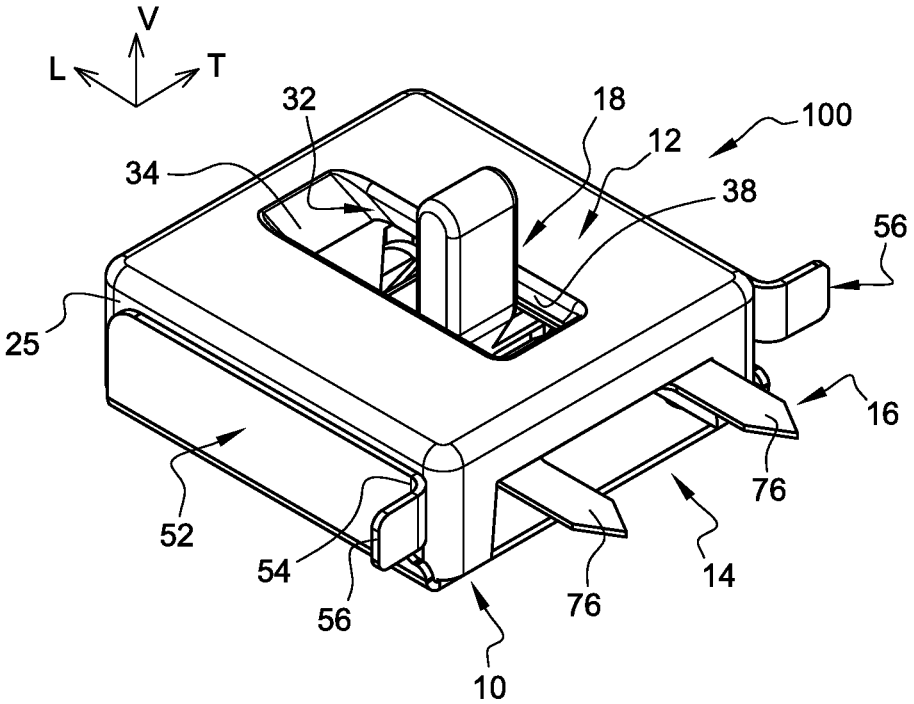
FIG. 1 is a perspective view of a first embodiment of an electric switch.
Figure 2:
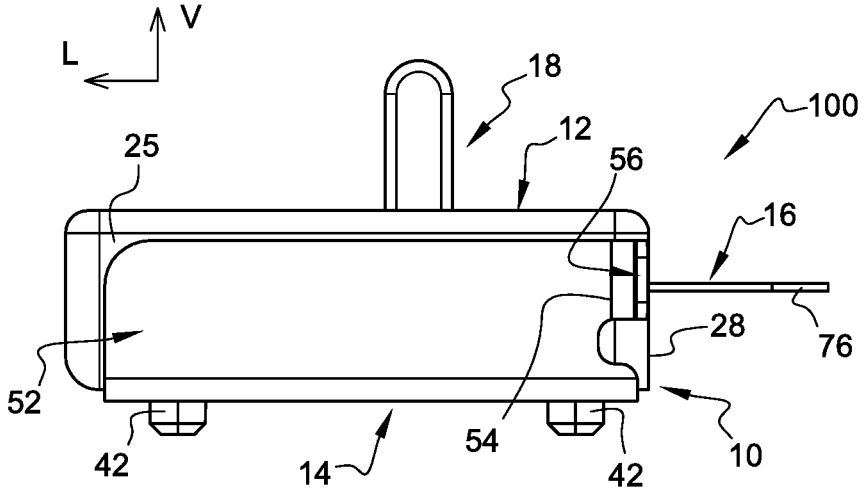
FIG. 2 is a side view of the electric switch illustrated in FIG. 1.
Figure 3:
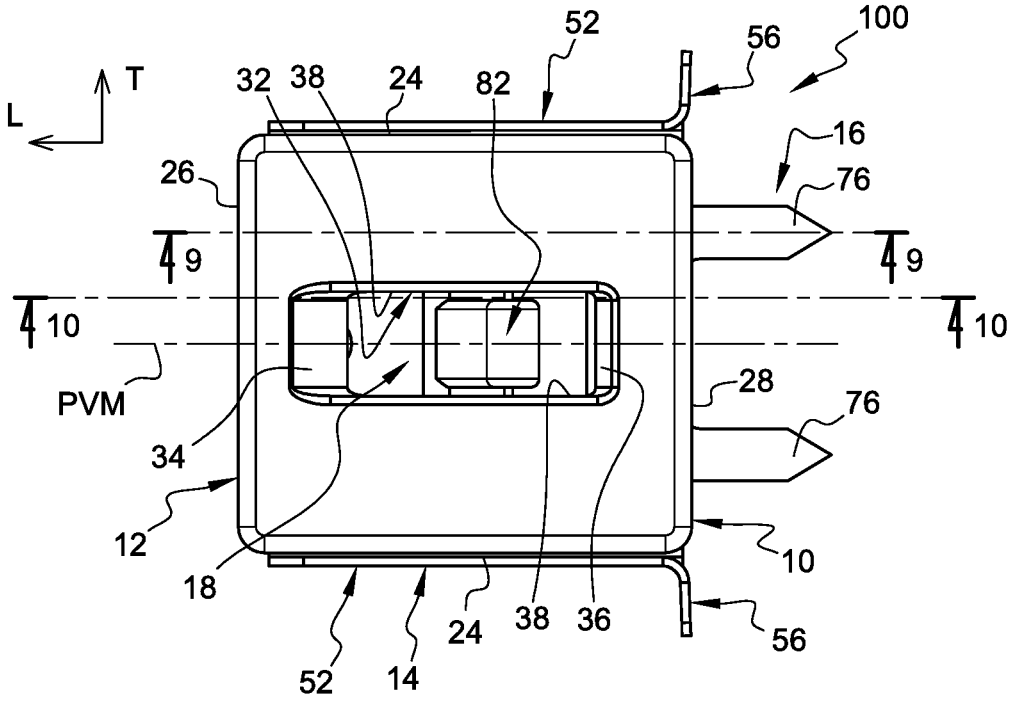
FIG. 3 is a top view of the electric switch illustrated in FIG. 1.
Figure 4:
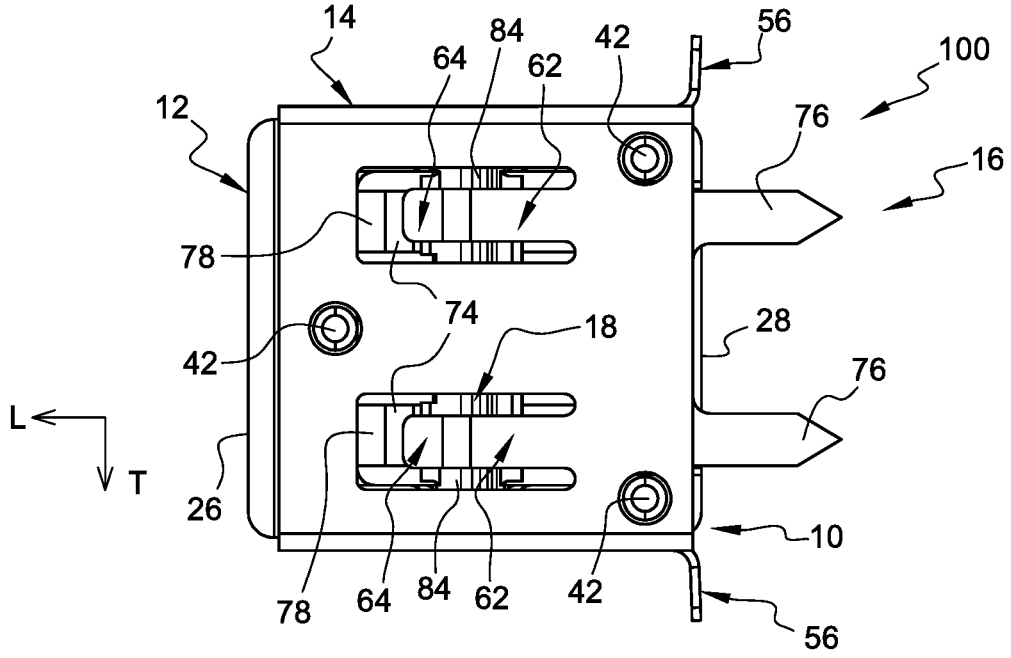
FIG. 4 is a bottom view of the electric switch illustrated in FIG. 1.
Figure 5:
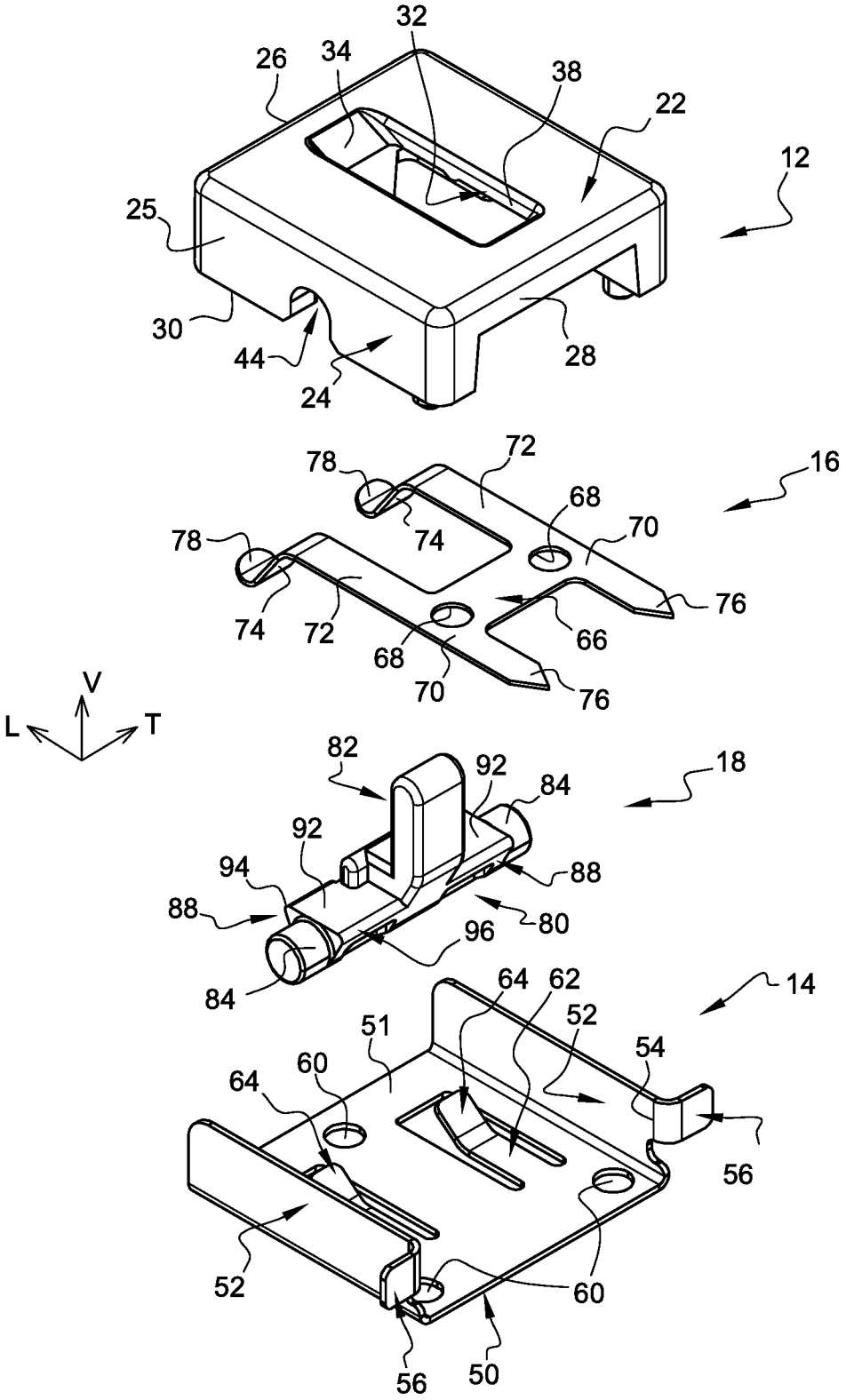
FIG. 5 is an exploded perspective view of the components of the electric switch illustrated in FIG. 1.
Figure 6:
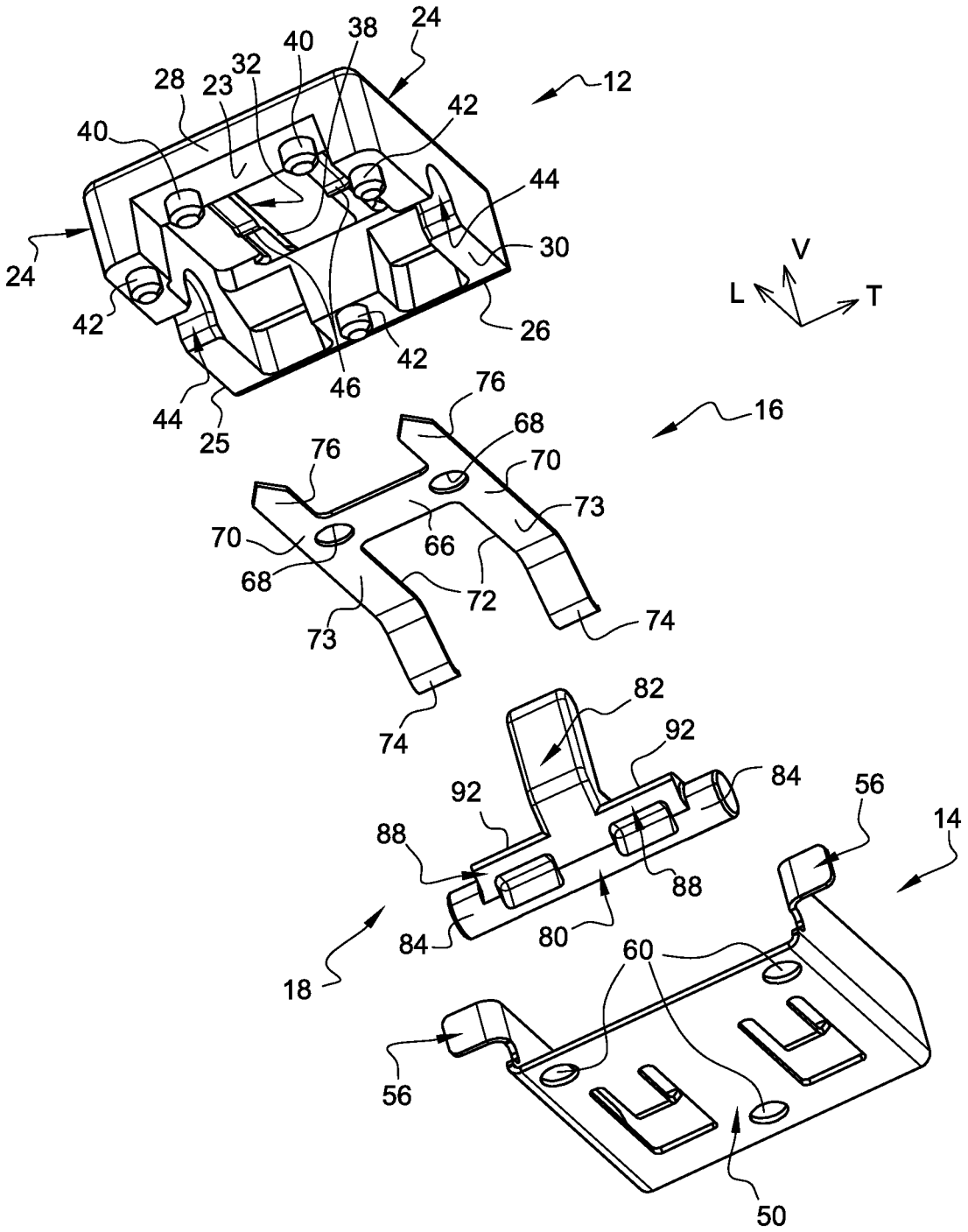
FIG. 6 is a view similar to that of FIG. 5 at another perspective angle.
Figure 7:
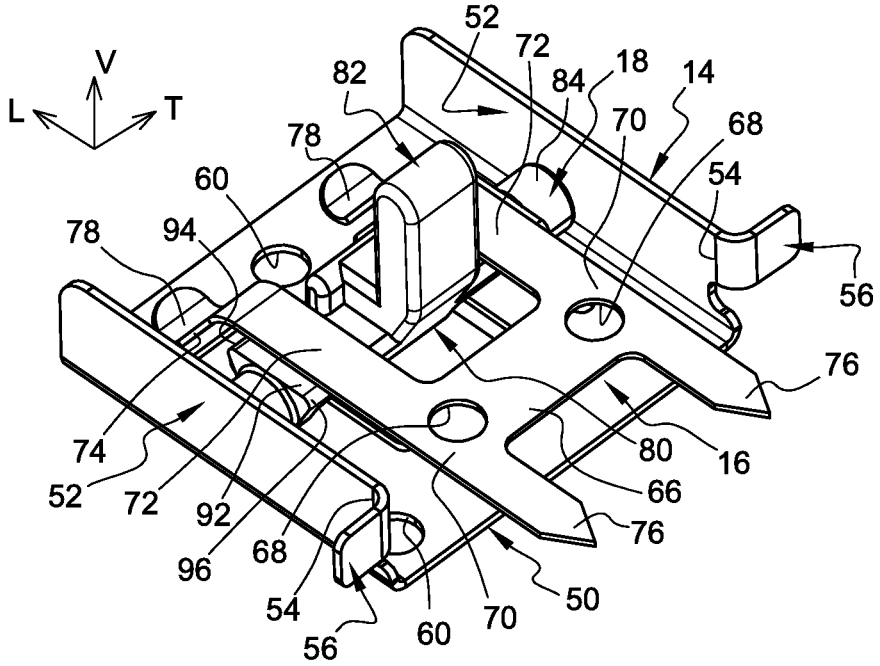
FIG. 7 is a view similar to that of FIG. 1 where the upper part of the housing and the actuator are not shown.
Figure 8:
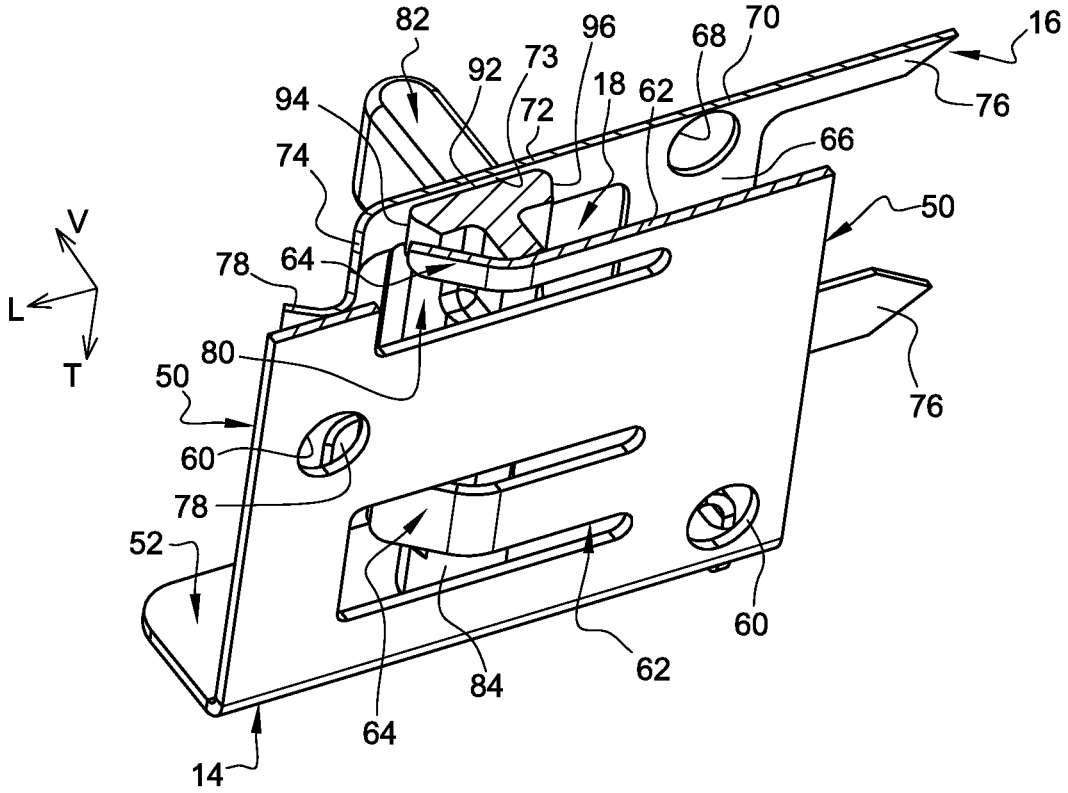
FIG. 8 is a perspective bottom and partial section view of the electric switch illustrated in FIG. 1 and where the upper part of the housing is not shown.

FIGS. 1 to 5 show a first embodiment of an electric switch 100 that in this case has general design symmetry with respect to the vertical and median longitudinal plane PVM indicated in FIG. 3.

The electric switch 100 comprises a housing 10 in two upper 12 and lower 14 parts that houses a dual internal contact blade 16 and an actuator 18.

The upper part 12 is a part moulded from insulating plastic material that is of general rectangular parallelepiped shape and that defines an internal housing 20 demarcated by a horizontal upper wall 22, by two vertical and longitudinal side walls 24 and by a front vertical and transverse wall 26.

The rear transverse face 28 is open, as is the horizontal lower face 30.

The upper wall 22 comprises a central through opening 32, which is demarcated by an inclined front transverse edge 34, by an inclined rear transverse edge 36 and by two longitudinal vertical faces 38 with a longitudinal orientation.

The internal face 23 of the upper wall 22 in this case comprises two vertical studs 40 for hot-crimping fixing of the internal contact blade 16, which studs are longitudinally arranged in the vicinity of the open rear transverse face 28.

The open lower face 30 comprises three vertical studs 42 arranged as a triangle for hot-crimping fixing of the lower part 14.

Substantially at the mid-length, each side wall 24 comprises a concave semi-cylindrical housing 44 that opens vertically downwards.

Transversely, on either side of the central opening 32, and substantially at the mid-length, the upper wall 22 comprises a locking lug 46 with a substantially V-shaped profile.

Figure 10:
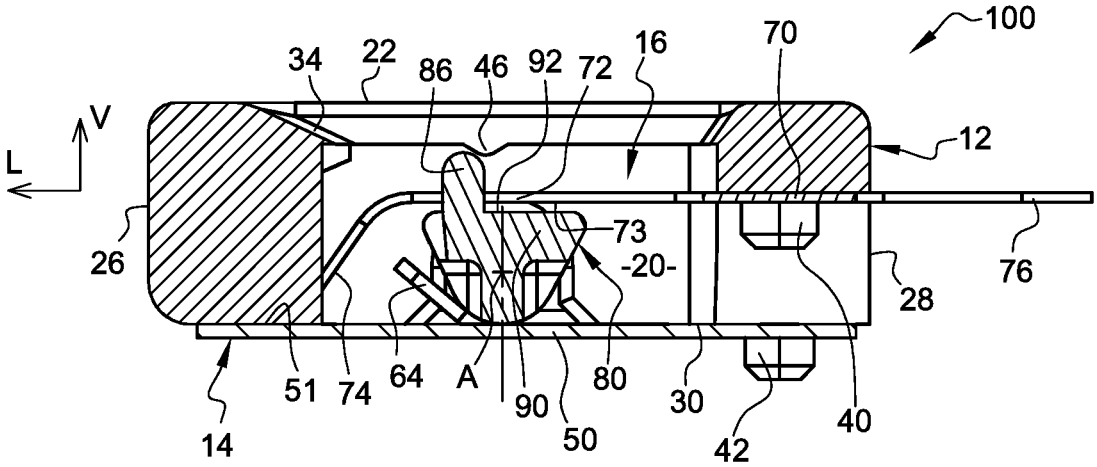
FIG. 10 is a view of the electric switch of FIG. 1 that is shown as a section view along the line 10-10 of FIG. 3.
Figure 11:
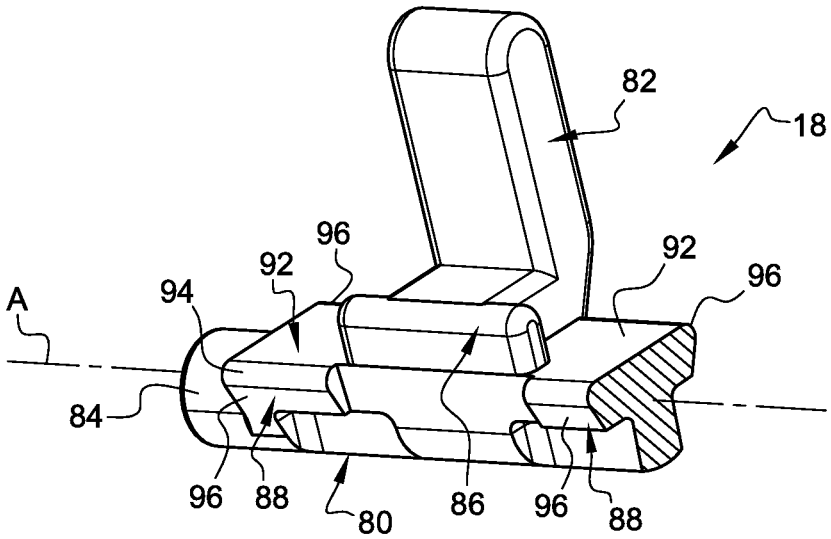
FIG. 11 is a large-scale perspective view of the actuator of the electric switch illustrated in FIGS. 1 to 10.
Figure 12:
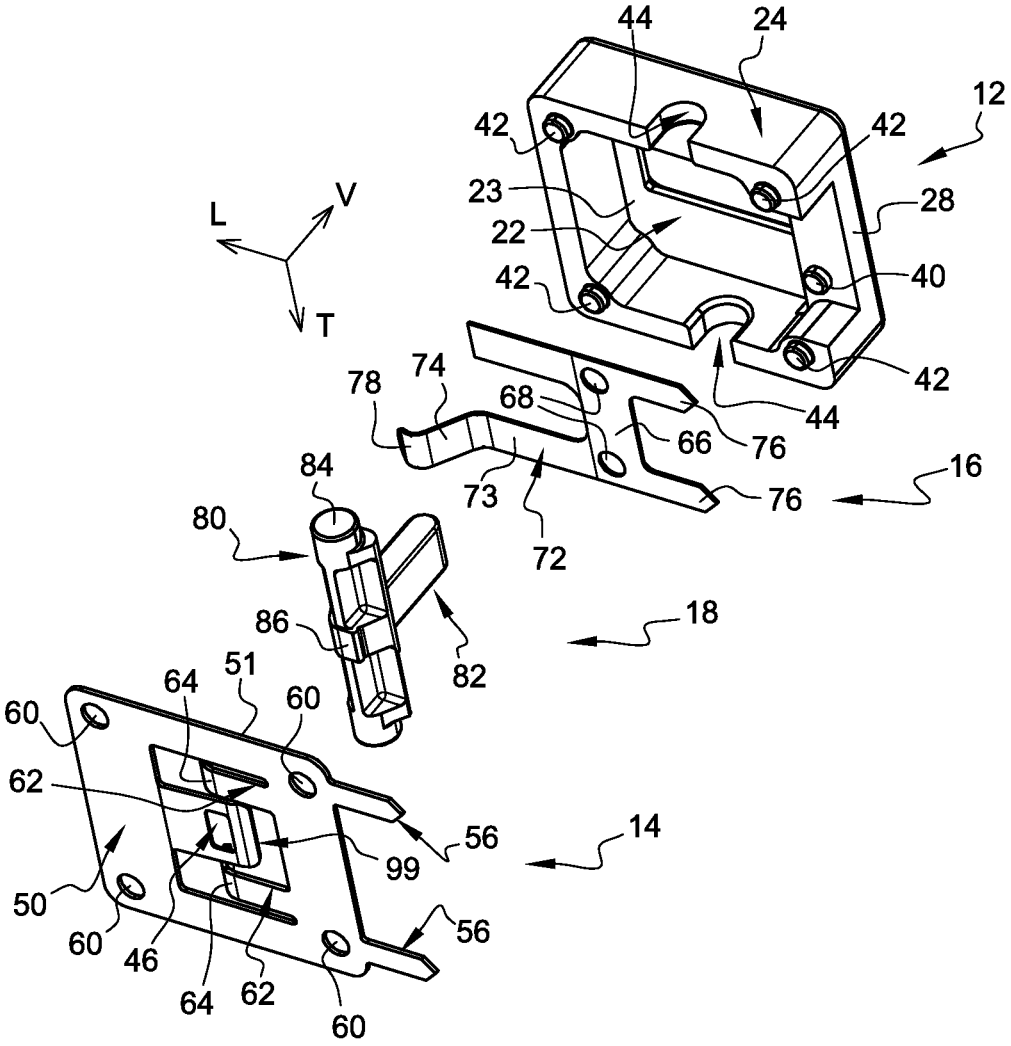
FIG. 12 is a view similar to that of FIG. 6 that illustrates a second embodiment of an electric switch according to the invention.
Figure 15:
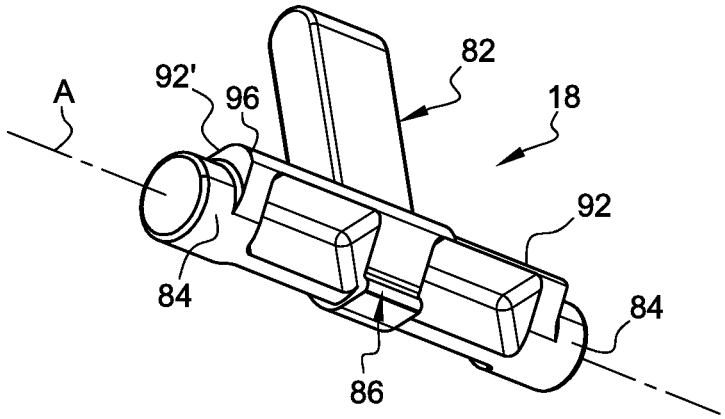
FIG. 15 is a large-scale perspective view of the actuator of the electric switch illustrated in FIGS. 12 to 14.
Figure 13:
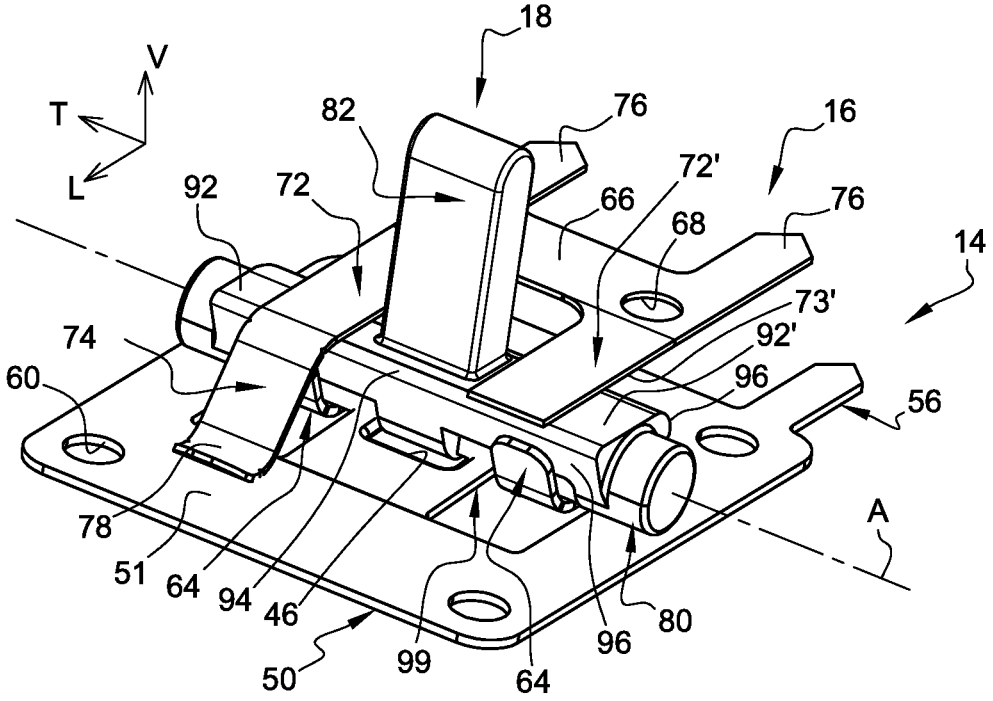
FIG. 13 is a view similar to that of FIG. 7 and that illustrates the second embodiment shown in FIG. 12.
Figure 14:
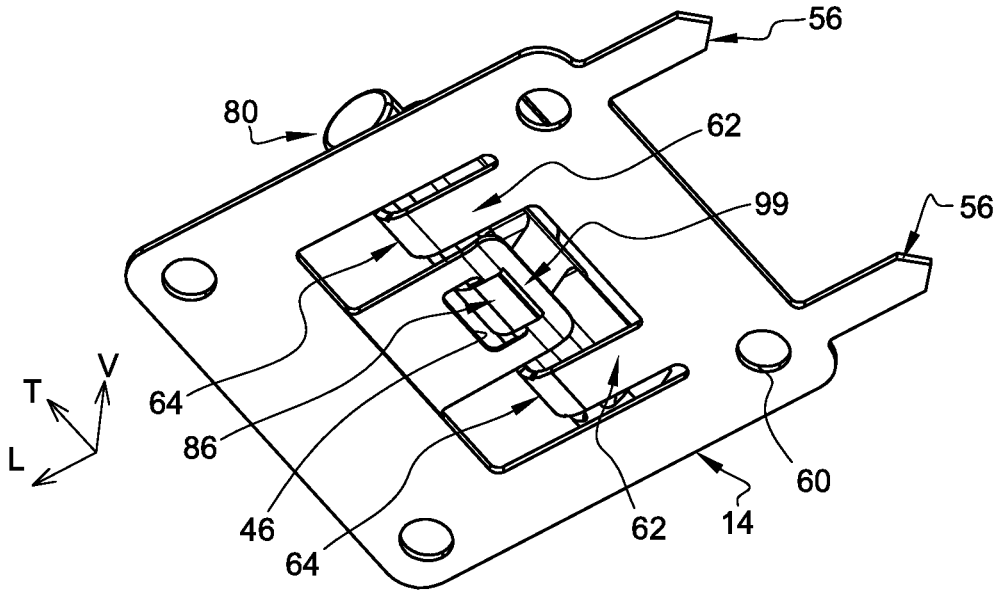
FIG. 14 is a view similar to that of FIG. 8 and that illustrates the second embodiment shown in FIG. 12.
Figure 16:
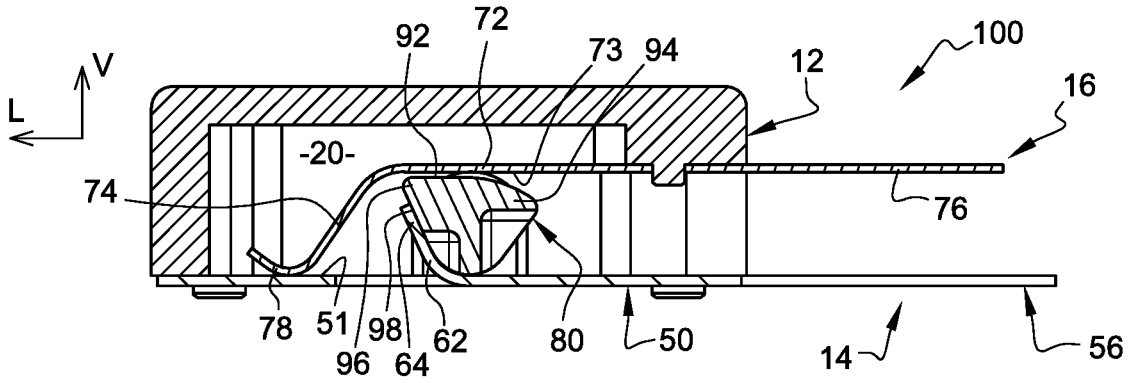
FIG. 16 is a view similar to that of FIG. 9 and that illustrates the second embodiment of the electric switch in its normally closed state.
Figure 17:
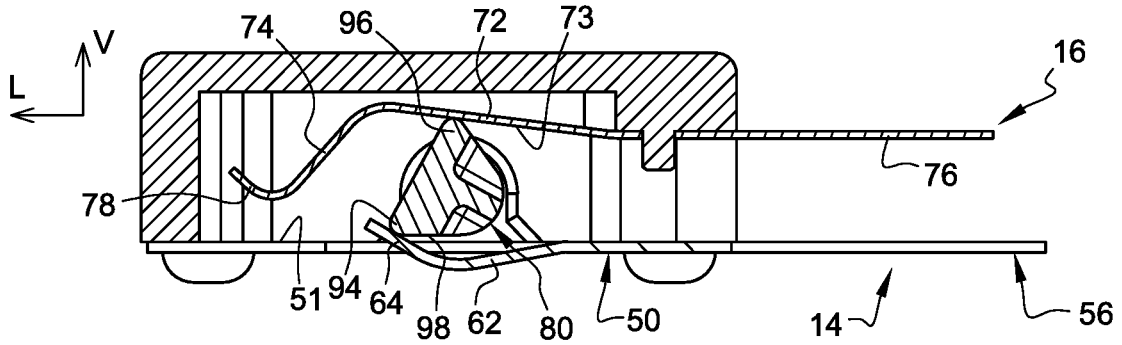
FIG. 17 is a view similar to that of FIG. 16 that illustrates the electric switch in its open unstable state.
Figure 18:
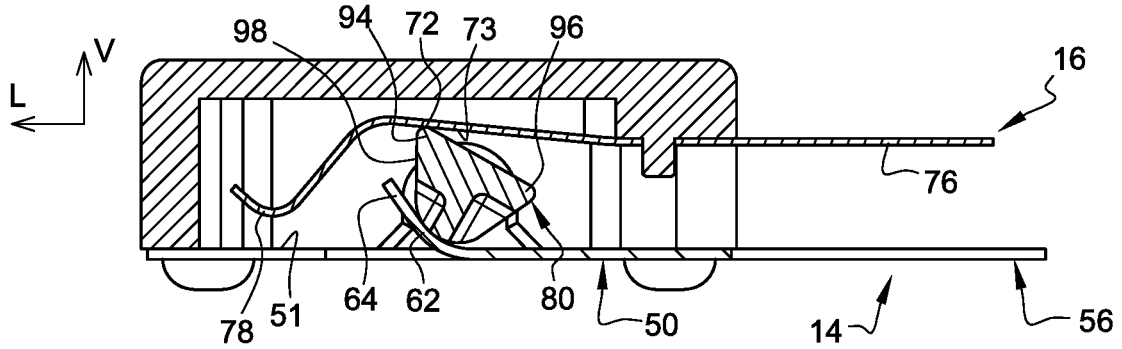
FIG. 18 is a view similar to that of FIG. 16 that illustrates the electric switch locked in its open stable state.
Figure 19:
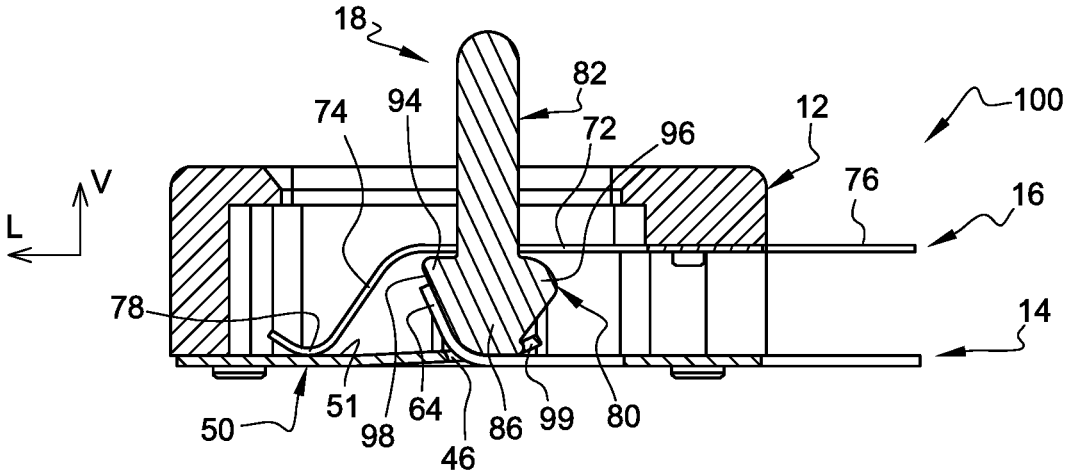
FIG. 19 is a view similar to that of FIG. 10 and that illustrates the second embodiment of the electric switch in its normally closed state.
Figure 20:
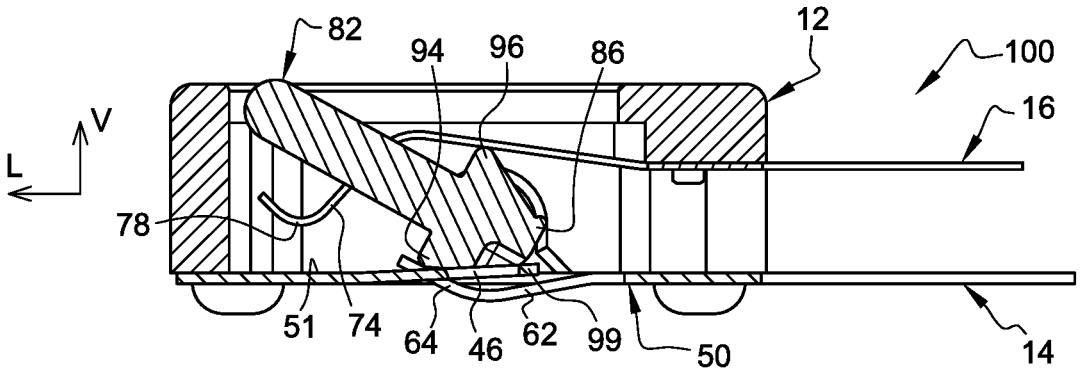
FIG. 20 is a view similar to that of FIG. 19 that illustrates the electric switch in its open unstable state.

The locking lugs 46 are slightly longitudinally offset towards the front relative to the central axis A of the housings 44 (see FIG. 10).

The lower part 14 of the housing 10 in this case is a part made from a conductive metal sheet that is produced by cutting and folding.

The lower part comprises a horizontal rectangular lower plate 50 that laterally extends by two vertical and longitudinal side panels 52.

The dimensions of the lower part 14 match those of the upper part so that, in the assembled position, the side panels 52 each extend along an external face 25 of a side wall 24, and substantially over the entire height of the upper part 12.

At its rear longitudinal end 54, each side panel is extended by an electric connection tab 56, which extends outwards in a vertical and transverse plane.

In order to close the housing 10, the horizontal lower plate 50 comprises three holes 60 arranged as a triangle, each hole is vertically passed through by a vertical stud 42 of the upper part 12.

On completion of the assembly and of the hot-crimping fixing, the periphery of the upper face 51 of the lower plate 50 is in abutment against the portions opposite the lower face 30 of the lower part.

The horizontal lower plate 50 comprises two resilient return branches 62.

Each return branch 62 is produced by cutting and folding and its front free end active section 64 is folded towards the inside of the internal housing of the upper part 12 of the housing 10.

By design, each return branch 62 is able to resiliently deform, in particular downwards. In FIGS. 1 to 10, the resilient return branches 62 are shown in their non-resiliently constrained state.

The internal contact blade 16 in this case is a dual blade, of symmetrical design with respect to the PVM plane, which is produced from a conductive metal sheet by cutting and folding.

The two internal electric contact blades per se are connected together by a horizontal fixing beam 66.

In order to fix each internal electric contact blade, the beam 66 comprises two holes 68, which are transversely spaced apart and each of which is vertically passed through by a vertical stud 40 of the upper part 12.

Each internal contact blade 16 comprises, successively and longitudinally from the back to the front, a rear fixing section 70, an intermediate actuating section 72 and a front contact section 74.

The rear fixing section 70, to which the beam 66 is fixed in order to be fixed below the lower face 23 of the upper wall 22 of the upper part 12 of the housing 10, in this case extends horizontally.

Each rear fixing section 70 in this case is longitudinally extended rearwards by an external electric connection section 76, which in this case is shaped into a pointed pin that longitudinally projects beyond the open rear transverse face 28.

Figure 9:
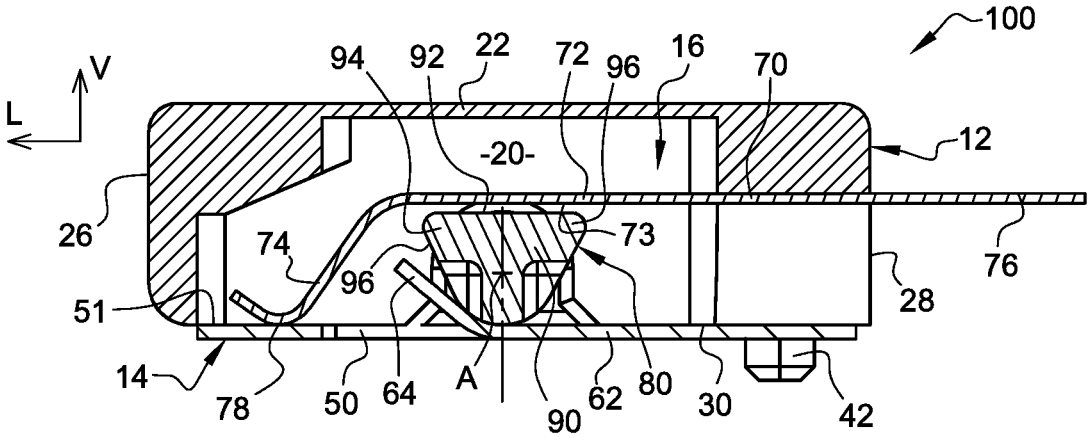
FIG. 9 is a view of the electric switch of FIG. 1 that is shown as a section view along the line 9-9 of FIG. 3.

At rest, i.e. without any action of the actuator 18 on the internal contact blades 16, each intermediate actuating section 72 horizontally extends in the extension of the sections 70 and 76, inside the housing 20, substantially at the mid-height (see FIGS. 9 and 10).

Each actuating section 72 is demarcated by a flat lower face 73.

From its front longitudinal end, each intermediate actuating section 72 extends forwards by a front contact section 74, which is vertically inclined downwards and terminates at an angled end 78, the convexity of which is oriented towards the internal upper face 51 of the horizontal lower plate 50.

At rest, i.e. without any action of the actuator 18 on the internal contact blades 16, each front contact section 74 is shaped so that its angled free end 78 is in downwards resilient contact abutment against a portion opposite the upper face 51 of the lower plate 50.

This portion opposite the upper face 51 of the lower plate 50 forms a fixed lower electric contact track for establishing an electric switching way between the lower plate 50 and its electric connection tabs 56, on the one hand, and the pointed connection sections 76, on the other hand.

This "at rest" state of the internal contact blades 16, and therefore of the electric switch 100, corresponds to the normally closed NC state of the switch.

Its actuating, and therefore its change of state, aims to interrupt the established electric switching way by lifting the angled free ends 78 vertically upwards, so that they are no longer in contact with the portions opposite the upper face 51 of the lower plate 50.

This upwards movement is obtained by resilient deformation of the internal contact blades 16 by acting on the intermediate actuating sections 72.

Such actuation and change of state to an open state is implemented by means of the actuator 18.

The actuator 18 is in the general shape of an internal transverse actuating shaft 80 and a drive arm 82.

The internal shaft 80 and its drive arm 82 in this case are produced as a single part by moulding from plastic material.

For the rotational assembly of the shaft, pivoting in both directions, relative to the housing 10, the internal transverse shaft comprises, at each of the two opposite transverse ends thereof, a cylindrical journal 84 that is rotationally accommodated, practically play-free, in a complementary housing 44 of the upper part 12, inside which housing it is trapped by the lower part 50.

The actuating shaft is thus rotationally mounted about the axis A.

In its central portion, the internal shaft 80 extends by a straight rotational drive arm.

By way of a non-limiting example, when the switch is in its rest state, normally illustrated in FIGS. 1 to 10, the drive arm 82 vertically extends through the central opening 32 above the upper wall 22.

The drive arm 82 is slightly longitudinally offset rearwards relative to the vertical plane passing through the axis of rotation A.

The transverse width of the drive arm 82 is slightly less than the transverse width of the central opening 32.

The maximum angular positions that the actuator 18 can reach in both directions correspond to the drive arm 82 coming into abutment with the inclined front transverse edge 34 or with the inclined rear transverse edge 36.

On either side of the drive arm 82, the internal shaft 80 comprises a locking lug 86, which is able to engage with an opposite locking notch 46.

As can be seen in FIG. 10, in the rest state illustrated in FIGS. 1 to 10, the upper end of the locking lug 86 with a cylindrical profile is slightly longitudinally offset towards the front and extends opposite the associated locking notch 46.

The assembly formed by a locking lug 86 and a locking notch 46 serves as a retractable locking means for locking the drive arm 82, and therefore the dual internal contact blade 16, in its second high stable position, in which the electric switching way is interrupted.

In order to be able to pivot the drive arm 82 clockwise with reference to FIG. 10, a force must be applied onto the drive arm 82 in the same direction that is high enough to be able to, through resilient deformation of the upper partition, retract the locking notch 46 and cause the locking lug 86 to angularly pass through to the other side.

Between each end journal 84 and the central drive arm 82, the internal shaft 80 comprises a control cam 88 for the deformations of the internal contact blades 16.

As a section view, the cam profile of each control cam 88 is generally triangular and comprises a flat horizontal upper section 92, which terminates with a front 94 and a rear 96 control elbow.

Each elbow 94, 96 is in the form of a convex cylinder arch. The front elbow 94 extends downwards through an inclined flat section 98.

Each cam 88 is transversely arranged in line with a return branch 62 and each inclined flat section 98 of the cam profile extends with play opposite a front free end active section 64.

In the rest position, the upper face of the flat horizontal upper section 92 in this case extends with slight vertical play relative to the lower face 73 of the associated actuating section 72.

The operation of the electric switch 100 will now be described.

In FIGS. 1 to 10, the switch 100 is shown in a rest position, in which the electric switching way is established by each of the two front contact sections 74 of the dual internal contact blade 16, with each internal blade 16 being in a bottom position relative to the lower plate 50.

This is a state (or position) of the electric switch that is called normally closed NC state.

From this normally closed NC state, and in order to cause the electric switch to change state, an actuation force needs to be applied to the drive arm 82 in order to cause it to pivot anti-clockwise with reference to FIGS. 9 and 10, and to thus cause the internal actuating shaft 80 to pivot in the same direction.

This pivoting causes the rear control elbow 96 to engage with the associated actuating section 72 of the internal blade 16 and the front contact section 74 to lift. This results in the vertical upwards lifting of the free end 78, which is no longer in contact with the portions opposite the upper face 51 of the lower plate 50.

Each internal blade 16 is then in a first high position relative to the lower plate 50.

The electric contact 51-78 opens practically immediately, but the angular actuation travel by pivoting the actuating arm 82 can continue. The electric switch 100 thus has the ability to absorb significant actuation over-travel.

This is a first open unstable position NOi of the electric switch, in which the electric switching way is interrupted.

This position or state NOi is unstable since, once an actuation force is no longer applied on the actuating arm 82, the actuator 18 is resiliently returned to its central angular rest position through the action of the return branches 62.

Indeed, other than the change of state NC→NOi of the electric switch, the angular actuation travel by pivoting the actuating arm 82 has simultaneously caused the resilient deformation of each of the return arms 62, due to the force that is applied to each return branch 62 by the inclined flat section 98 of the associated cam 88.

When the actuation force applied to the actuating arm 82 is released, the return branches 62 exert their return force on the internal shaft 80, which returns to its central angular rest position.

An additional return force is added to the return force exerted by the return branches 62, which additional return force in this case is exerted by the two front contact sections 74, which engage with the rear elbows 96.

From the normally closed NC position, and in order to cause temporary locking of the electric switch in a stable open state NOs, an actuation force needs to be applied to the drive arm 82 in order to cause it to pivot clockwise with reference to FIGS. 9 and 10, and to thus cause the internal actuating shaft 80 to pivot in the same clockwise direction.

This pivoting causes the front control elbow 94 to engage with the associated actuating section 72 and the front contact section 74 of each internal blade 16 to lift.

This results in the free end 78 vertically lifting upwards, which free end is no longer in contact with the portions opposite the upper face 51 of the lower plate 50.

Each internal blade 16 is then in a second high position relative to the lower plate 50.

The electric contact 51-78 opens practically immediately.

It is a second stable open position NOs of the electric switch, in which the electric switching way is interrupted.

This position or state NOs is stable since, when an actuation force is no longer applied to the actuating arm 82, said arm remains angularly locked by the locking means 46-86.

Indeed, by pivoting clockwise, the drive arm 82 has caused resilient deformation of the upper partition in order to retract the locking notch 46 and cause the locking lug 86 to angularly pass through to the other side.

When the actuation force applied to the actuating arm 82 is released, said arm remains locked and the electric switch remains in its open stable state.

In order to unlock the electric switch 100, an unlocking force must be applied to the drive arm 82, in order to cause it to pivot clockwise, that is high enough to (through resilient deformation of the upper partition) again retract the locking notch 46 and cause the locking lug 86 to angularly pass through to the other side of the locking notch 46.

The drive shaft 80 is then again in its central angular position and the electric switching way is re-established.

The dual design of the internal contact blade 16 allows, for some applications, a contact redundancy to be provided that is useful if, for example, the electric switch is not sealed and that an impurity is introduced between the free end 78 and the upper face 51.

Second Embodiment: Single Internal Contact Blade

The second embodiment illustrated in FIGS. 12 to 23 will be described compared to the first embodiment.

It basically differs through the design of the internal contact blade 16, which is a single blade, through the design of the locking means of the drive arm 82, and through the design of the electric connection means of the lower plate 50.

The internal contact blade 16 is a single blade, i.e. it only comprises a single part with an intermediate actuating section 72 and a front contact section 74, 78.

The other section 72', of symmetrical and similar design to that of the actuating section 72, does not extend by a contact section and therefore does not have a function for establishing or interrupting an electric contact.

However, it engages, by its horizontal lower face 73', with the flat horizontal upper section 92' opposite the associated control cam 88', in order to reliably determine the central angular rest position of the actuating shaft 80.

The section 72' thus exercises a function for stabilizing the actuating shaft 80 in the rest position.

Its additional resilient return effect also can be enhanced, for example, by providing it with greater stiffness than that of the actuating section 72, or even by initially folding or bending the section 72', so that it exerts a pre-stress on the flat horizontal upper section 92' opposite the associated control cam 88'.

By acting as temporary locking means in the stable normally open position NOs (see FIGS. 18 and 21 in particular), the locking notch 46 is an opening that is formed in a resiliently deformable tab 99, which is centrally produced in the lower plate 50, transversely between the two resilient return branches 62.

The additional locking lug 86 is formed on the lower part of the actuator 18.

Figure 21:
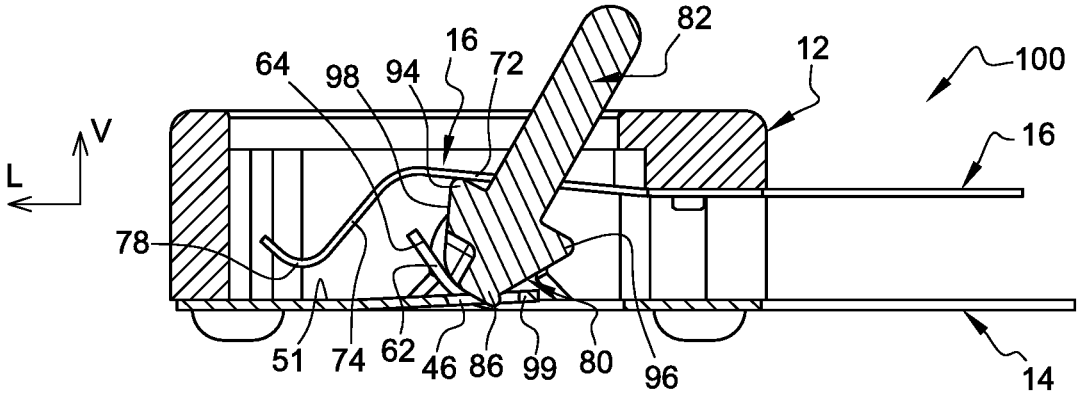
FIG. 21 is a view similar to that of FIG. 19 that illustrates the electric switch locked in its open stable state.

More specifically, in the central part thereof, in line with the actuating arm 82, the drive shaft 80 comprises a spout-shaped pin that is able to be accommodated in the opening 46 when the electric switch is locked in its open stable state NOs (see FIG. 21).

The rear profile of the locking lug 86 is shaped to allow unlocking.

Instead of electric connection tabs, the lower plate 50 comprises two pointed pins 56, which longitudinally project beyond the open rear transverse face 28, like the electric connection sections 76 of the internal contact blade.

The operation of the electric switch 100 according to this second embodiment is identical to that previously described with reference to the first embodiment, and which is illustrated in detail in FIGS. 16 to 21.

Figure 22:
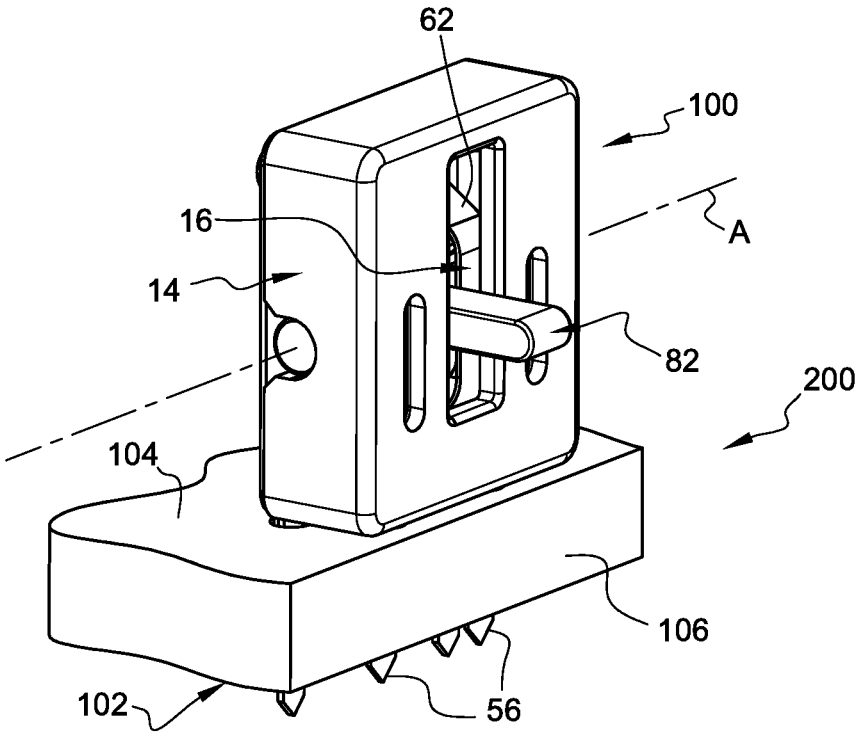
FIG. 22 is a perspective view that illustrates the electric switch shown in FIGS. 12 to 21, in position assembled on a face of a printed circuit board or plate.
Figure 23:
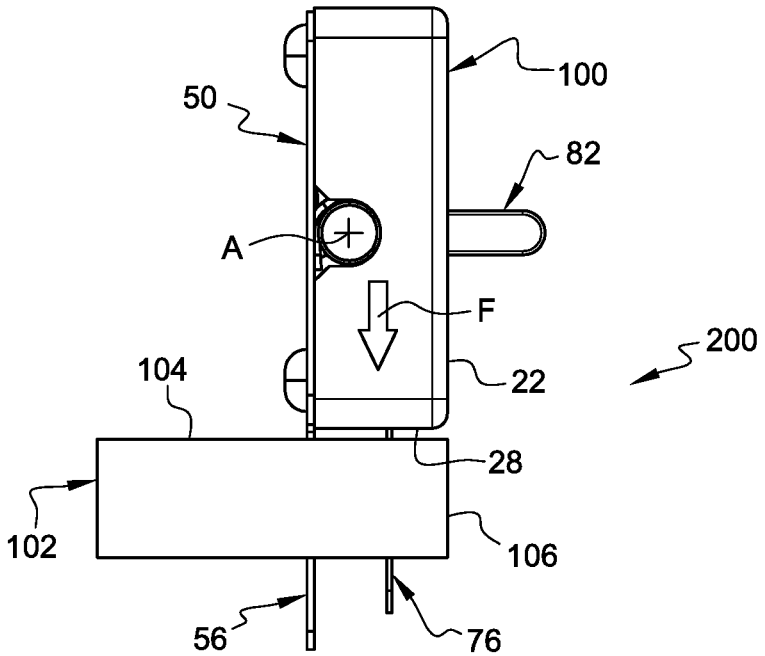
FIG. 23 is a side view of the assembly illustrated in FIG. 22.

As can be seen in FIGS. 22 and 23, an electric switch 100 according to the invention can be mounted on a face 104 of an electronic board particularly comprising a printed circuit plate 102, which is demarcated by an edge 106 in order to form an assembly 200.

The switch 100 is close to the edge 106 of the plate 102 and, as can be seen in FIG. 23, the external face of its wall 22 is substantially aligned with the edge 106.

Such an assembly and positioning of the electric switch 100 can, if the assembly 200 is installed in an electronic appliance (not shown) in the direction indicated by the arrow F of FIG. 23, allow automatic unlocking of the electric switch 100 by bringing the actuating arm 82 into contact with a portion opposite the electronic appliance or belonging to automated assembly means.

The invention claimed is:

1. A normally closed electric switch comprising: a housing comprising an upper part made of insulating material and a complementary lower part that supports a fixed internal contact track; an internal contact blade that is supported by the upper part and that is resiliently deformable in order to assume: a bottom rest position, in which the internal contact blade is in downwards resilient abutment on the fixed internal contact track in order to establish an electric switching way, a first high non-stable position, in which the electric switching way is interrupted, and a second high stable position, in which the electric switching way is interrupted and in which the internal contact blade is locked by a retractable lock; an actuator to control the deformation of the internal contact blade, wherein the actuator, is pivotably mounted about a horizontal pivot axis, between: a first angular actuating position, in which the internal contact blade is in its first high non-stable position, and a second angular actuating position, in which the internal contact blade is in its second high stable position.

2. The electric switch according to claim 1, wherein the rest position of the actuator is an intermediate angular position between its first and second angular positions for activating the internal contact blade.

3. The electric switch according to claim 1, wherein:

the internal contact blade successively comprises:

a rear section for fixing the internal contact blade to the upper part of the housing, an intermediate actuating section, and a front contact section, which in the bottom rest position of the internal contact blade, is in downwards resilient abutment on the fixed internal contact track in order to establish the electric switching way; and the actuator comprises a control cam, a cam profile of which engages with the intermediate actuating section of the internal contact blade.

4. The electric switch according to claim 3, characterized in that the resiliently deformable internal contact blade engages with the control cam of the actuator to assist the resilient return of the actuator towards its rest position.

5. The electric switch according claim 3, wherein the intermediate actuating section of the internal contact blade extends substantially horizontally above the control cam and above the pivot axis.

6. The electric switch according to claim 5, wherein the pivot axis is located inside the housing.

7. The electric switch according to claim 1, wherein:

the upper part of the housing comprises a locking notch; and the actuator comprises a locking lug that engages with the locking notch in order to lock the internal contact blade in its second high stable position.

8. The electric switch according to claim 1, wherein:

the lower part of the housing comprises a locking notch; and the actuator comprises a locking lug that engages with the locking notch for locking the internal contact blade in its second high stable position.

9. The electric switch according to claim 1 further comprising an internal blade for stabilizing the actuator that comprises a stabilization section, and wherein the actuator comprises a control cam, a cam profile of which engages with the stabilization section of the internal blade.

10. The electric switch according to claim 1, wherein:

the lower part of the housing comprises a horizontal lower plate for closing the housing; and the fixed internal contact track is a portion of an upper face of the lower plate.

11. The electric switch according to claim 9, wherein the lower plate of the lower part of the housing comprises a resiliently deformable branch that engages with a complementary portion opposite the actuator to assist in resilient return of the actuator from the first angular actuating position to the rest position.

12. The electric switch according to claim 1 further comprising an internal blade for stabilizing the actuator that comprises a stabilization section, and wherein:

the lower part of the housing comprises a locking notch;

the actuator comprises a locking lug that engages with the locking notch for locking the internal contact blade in its second high stable position;

the actuator also comprises a control cam, a cam profile of which engages with the stabilization section of the internal blade; and the lower plate of the lower part of the housing comprises a resiliently deformable tab that comprises the locking notch.

13. The electric switch according to claim 1, wherein the actuator comprises an arm for causing the actuator to pivot in both directions, which arm vertically projects upwards through the upper part of the housing.

14. The electric switch according to claim 1, wherein the second high stable position of the internal contact blade corresponds to an initial delivery state of the electric switch.

15. An assembly comprising an electronic board and the electric switch according to claim 1, wherein the electric switch is mounted on a face of the electronic board and is adjacent to an edge of the electronic board so that, when the assembly is placed in an electronic appliance, the internal contact blade of the electric switch is automatically unlocked as a result of its actuator coming into contact with a portion opposite the electronic appliance or belonging to the assembly.

* * * * *